US006806398B2

(12) United States Patent
Sakai et al.

(10) Patent No.: US 6,806,398 B2
(45) Date of Patent: Oct. 19, 2004

(54) PROCESS FOR REMOVING MERCURY FROM LIQUID HYDROCARBON

(75) Inventors: Tsunenori Sakai, Yamaguchi (JP); Hajime Ito, Yamaguchi (JP); Jun Mase, Yamaguchi (JP)

(73) Assignee: Idemitsu Petrochemical Co., Ltd., Tokyo (JP)

( * ) Notice: Subject to any disclaimer, the term of this patent is extended or adjusted under 35 U.S.C. 154(b) by 0 days.

(21) Appl. No.: 10/148,184

(22) PCT Filed: Oct. 1, 2001

(86) PCT No.: PCT/JP01/08641

§ 371 (c)(1),
(2), (4) Date: Jun. 6, 2002

(87) PCT Pub. No.: WO02/36717

PCT Pub. Date: May 10, 2002

(65) Prior Publication Data

US 2002/0179452 A1 Dec. 5, 2002

(30) Foreign Application Priority Data

Oct. 30, 2000 (JP) ..... 2000-330871
Jan. 23, 2001 (JP) ..... 2001-14512

(51) Int. Cl.[7] ..... C07C 7/10; C07C 7/154; C07C 7/00; C10G 29/04

(52) U.S. Cl. ..... 585/836; 585/833; 585/877; 585/850; 585/856; 208/251 R; 208/253

(58) Field of Search ..... 585/836, 833, 585/877, 850, 856; 208/251 R, 253

(56) References Cited

U.S. PATENT DOCUMENTS 6,268,543 B1 * 7/2001 Sakai et al. ..... 585/836

FOREIGN PATENT DOCUMENTS

| | | |
|---|---|---|
| JP | 1-289894 | 11/1989 |
| JP | 2-24688 | 2/1990 |
| JP | 3-250092 | 11/1991 |
| JP | 2000-212576 | 8/2000 |

* cited by examiner

*Primary Examiner*—Walter D. Griffin
*Assistant Examiner*—Tam M. Nguyen
(74) *Attorney, Agent, or Firm*—Oblon, Spivak, McClelland, Maier & Neustadt, P.C.

(57) ABSTRACT

The continuous process for removing mercury comprises a step of continuously feeding a mercury-containing liquid hydrocarbon to an ionization zone where the elementary mercury is ionized; and a step of continuously feeding the liquid hydrocarbon containing the ionized mercury to a sulfur compound-treatment zone where the ionized mercury is converted to a solid mercury compound. The semi-continuous process for removing mercury comprises a step of continuously feeding a mercury-containing liquid hydrocarbon to an ionization column where the elementary mercury is ionized; and a step of feeding the liquid hydrocarbon containing the ionized mercury to a sulfur compound-treatment tank where the ionized mercury is converted to a solid mercury compound in batch manner. With the above processes, the mercury is removed from the liquid hydrocarbon with ease in a continuous or semi-continuous manner at around ordinary temperature under around ordinary pressure.

20 Claims, No Drawings

PROCESS FOR REMOVING MERCURY FROM LIQUID HYDROCARBON

TECHNICAL FIELD

The present invention relates to a process for removing mercury from a mercury-containing liquid hydrocarbon.

BACKGROUND ART

Natural gas liquids (NGL) obtained from natural gas field, i.e., liquid hydrocarbons such as liquefied petroleum gas and condensates, contain mercury in an amount of 2 to several thousands ppb although it varies depending upon the production area. Therefore, light hydrocarbons obtained by distilling NGL tend to still contain mercury.

When a liquid hydrocarbon containing mercury is used as a raw chemical material, the mercury corrodes apparatus by forming amalgam with aluminum which constitutes the apparatus, or reduces the activity of a reforming catalyst. Therefore, it has been strongly demanded to develop a technique for removing mercury from the liquid hydrocarbon.

To meet such a demand, Japanese Patent Application Laid-Open No. 10-251667 proposes a method of removing a trace amount of mercury in a hydrocarbon fraction by a combination of hydrogenation and adsorption, in which a hydrocarbon fraction containing mercury is first subjected to hydrogenation, and then the hydrogenated hydrocarbon fraction is contacted with a porous carbonaceous material.

In this method, however, the hydrogenation must be performed under high-temperature and high-pressure conditions, i.e., at 100 to 400° C., preferably 250 to 350° C. under 1 to 5 MPa, preferably 2.5 to 3.5 MPa. Therefore, the method is energy-intensive because a lot of energy is required for heating and pressurizing. Further, the preparation process of the porous carbonaceous material used as an adsorbent is extremely complicated because the adsorbent is required to have strictly controlled properties such as a specific surface area of 100 to 2,500 $m^2/g$, preferably 500 to 1,500 $m^2/g$; an average pore radius of 5 to 30 Å; and a pore volume of 0.2 to 1.2 mL/g with respect to pores having a pore radius of 50 Å or smaller.

DISCLOSURE OF INVENTION

It is an object of the present invention to provide a process for efficiently removing mercury from a mercury-containing liquid hydrocarbon in a continuous and simple manner or in a semi-continuous and simple manner at around ordinary temperature under around ordinary pressure.

As a result of extensive research in view of the above object, the inventors have found that mercury is effectively removed from a mercury-containing liquid hydrocarbon in a continuous and simple manner by continuously introducing the mercury-containing liquid hydrocarbon into a mercury-ionization zone and then a sulfur compound-treatment zone.

The inventors have further found that mercury is effectively removed from a mercury-containing liquid hydrocarbon in a semi-continuous manner by continuously feeding the mercury-containing liquid hydrocarbon into a mercury-ionization column, and then feeding into a sulfur compound-treatment tank to convert the mercury to a solid mercury compound in a batch manner.

Thus, in a first aspect of the present invention, there is provided a process for removing mercury from a liquid hydrocarbon, comprising:

(A) continuously feeding a mercury-containing liquid hydrocarbon into an ionization zone where the liquid hydrocarbon is contacted with an ionizing substance capable of ionizing elementary mercury, thereby ionizing the elementary mercury in the liquid hydrocarbon;

(B) continuously feeding the resultant liquid hydrocarbon containing the ionized mercury into a sulfur compound-treatment zone where the liquid hydrocarbon is contacted with a sulfur compound represented by the general formula:

MM'S wherein M and M' may be the same or different and are each independently a hydrogen atom, an alkali metal or an ammonium group, or contacted with a liquid containing the sulfur compound, thereby converting the ionized mercury into a solid mercury compound; and (C) removing the solid mercury compound from the liquid hydrocarbon.

In a second aspect of the present invention, there is provided a process for removing mercury from a liquid hydrocarbon, comprising:

(A) feeding the liquid hydrocarbon into an ionization column where the liquid hydrocarbon is contacted with a substance capable of ionizing elementary mercury, thereby ionizing the elementary mercury contained in the liquid hydrocarbon;

(B) feeding the resultant liquid hydrocarbon containing the ionized mercury to a sulfur compound-treatment tank where the liquid hydrocarbon is contacted with a sulfur compound represented by the general formula:

MM'S wherein M and M' may be the same or different, and are each independently a hydrogen atom, an alkali metal or an ammonium group, or contacted with a liquid containing the sulfur compound, thereby converting the ionized mercury to a solid mercury compound; and (C) removing the solid mercury compound from the liquid hydrocarbon.

BEST MODE FOR CARRYING OUT THE INVENTION

The mercury-containing liquid hydrocarbons to be treated by the process of the present invention are not particularly restricted, and may include any hydrocarbons which are liquid at ordinary temperature. Examples of the liquid hydrocarbons include crude oil, straight run naphtha, kerosene, gas oil, vacuum distillates, topped crude, and natural gas condensate (NGL). Of these liquid hydrocarbons, preferred is the natural gas condensate (NGL).

The mercury to be removed by the process of the present invention may be in either of elementary form or ionic form. The concentration of mercury in the liquid hydrocarbon to be treated is not particularly restricted, and is usually 2 to 1,000 W/V ppb, preferably 5 to 100 W/V ppb.

The crude oil to be treated in the present invention is not particularly restricted. Examples of the crude oil are those produced in Saudi Arabia, United Arab Emirates, Nigeria, Algeria, Canada, Mexico, Iran, Iraq, China, Kuwait, Malaysia, Venezuela, America, Australia, Russia, Libya, Philippines, Indonesia, Norway, Thai Land, Qatar, Argentina, England, and Japan. These crude oils may be used in combination of two or more.

The straight run naphtha, kerosene, gas oil, vacuum distillate and topped crude are obtained by processing the crude oil by known methods.

(1) First Embodied Process

In the first embodied process of the present invention, the liquid hydrocarbon is continuously supplied to the ionization zone, thereby bringing the elementary mercury in the liquid hydrocarbon into contact with the substance capable of ionizing elementary mercury.

Examples of the substance capable of ionizing elementary mercury (hereinafter occasionally referred to as "mercury-ionizing substance") include an iron compound such as iron sulfate, iron chloride, iron sulfide, iron oxide, iron nitrate and iron oxalate, preferably iron(III) compounds; a copper compound such as copper sulfate, copper chloride, copper oxide, copper nitrate and copper sulfide; a vanadium compound; a manganese compound, preferably manganese dioxide; a nickel compound; an inorganic or organic peroxide such as hydrogen peroxide and peracetic acid; and a sludge in crude oil tank. These mercury-ionizing substances may be used alone or in combination of two or more. Elemental analysis of a typical crude oil tank sludge are shown below.

Fe: 36 wt %; Si: 1.3 wt %; Na: 3,600 wt ppm; Al: 2,700 wt ppm; P: 2,200 wt ppm; Zn: 2,100 wt ppm; Cu: 950 wt ppm; Ca: 720 wt ppm; Mg: 550 wt ppm; V: 350 wt ppm; K: 350 wt ppm; Cr: 290 wt ppm; Mn: 230 wt ppm; Ni: 120 wt ppm; C: 32.0 wt %; H: 3.0 wt %; N: 0.9 wt %; S: 3.0 wt %; and Cl: 0.4 wt %.

The manganese compounds such as manganese oxide may be of any shape such as powdery form, pulverized form, columnar form, spherical form, fibrous form and honeycomb form. In addition, the manganese compounds may be supported on a carrier such as silica, alumina, silica-alumina, zeolite, ceramic, glass, resin and activated carbon. The supporting amount is not particularly restricted, and is preferably 0.1 to 30% by weight based on the weight of the carrier.

In the process of the present invention, the elementary mercury in the liquid hydrocarbon is brought into contact with the mercury-ionizing substance in the ionization zone, thereby converting the elementary mercury to ionic mercury. The contact temperature is usually −50 to 100° C., preferably 0 to 60° C. The contact pressure may be 0 to 2 MPa. Basically, the pressure is not specifically limited as far as the liquid hydrocarbon is maintained in a liquid state at the contact temperature being used.

The liquid hydrocarbon having passed through the ionization zone in a liquid space velocity of 1 to 20 $h^{-1}$ is then continuously supplied to the sulfur compound-treatment zone, where the liquid hydrocarbon is contacted with a sulfur compound represented by the general formula:

MM'S wherein M and M' may be the same or different, and are each independently a hydrogen atom, an alkali metal or an ammonium group, or contacted with a liquid containing the sulfur compound. Examples of the sulfur compounds represented by the general formula of MM'S include hydrogen sulfide, sodium hydrosulfide, potassium hydrosulfide, sodium sulfide, potassium sulfide, and ammonium sulfide. Of these sulfur compounds, preferred is hydrogen sulfide. Hydrogen sulfide may be introduced in gaseous form or in liquid form under pressure. In addition, hydrogen sulfide may be supplied in the form of solution in water, an organic solvent or a water-organic solvent.

The concentration of the sulfur compound in the liquid, especially an aqueous solution, is preferably 0.1 to 100,000 W/W ppm, more preferably 1 to 1,000 W/W ppm, although not particularly restricted thereto.

The supplied amount of the sulfur compound is 1 to 10,000 mol, preferably 100 to 5,000 mol per one mol of the mercury contained in the liquid hydrocarbon. The contact of the sulfur compound with the liquid hydrocarbon is performed, for example, but not particularly restricted, by mixing in a mixer or a line mixer. The temperature of contact treatment is usually −50 to 100° C., preferably 0 to 60° C., and the pressure of contact treatment is 0 to 2 MPa. The residence time in the sulfur compound-treatment zone is usually 0.1 to 24 hr.

As described above, the mercury is converted to the solid mercury compound through the ionization of mercury and the contact of the ionized mercury with the sulfur compound. The solid mercury compound is removed from the liquid hydrocarbon by a known solid-liquid separation method such as filtration and sedimentation.

(2) Second Embodied Process

In the second embodied process of the present invention, the liquid hydrocarbon is supplied to the ionization column, where the liquid hydrocarbon is brought into contact with the mercury-ionizing substance. The type and amount of use of the mercury-ionizing substance are as described above with respect to the first embodied process.

The liquid hydrocarbon supplied to the ionization column is contacted with the mercury-ionizing substance, and the elementary mercury therein is converted to ionic mercury. The contact temperature is usually −50 to 100° C., preferably 0 to 60° C. The contact pressure may be 0 to 2 MPa. Basically, the pressure is not specifically limited as far as the liquid hydrocarbon is maintained in a liquid state at the contact temperature being used.

The liquid hydrocarbon having passed through the ionization column in a liquid space velocity of 1 to 20 $h^{-1}$ is then supplied to the sulfur compound-treatment tank where the liquid hydrocarbon is batch-wisely contacted with the sulfur compound for 0.1 to 72 h represented by the general formula:

MM'S wherein M and M' are as defined above, or contacted with a liquid, especially an aqueous solution, containing the sulfur compound. The liquid hydrocarbon fed to the sulfur compound-treatment tank may contain water. Also, an appropriate amount of water may be added to the liquid hydrocarbon supplied into the sulfur compound-treatment tank.

The sulfur compounds of MM'S, the concentration of the sulfur compound in the liquid, the amount of use of the sulfur compound and the contacting method of the sulfur compound with the liquid hydrocarbon are as described above.

Like the first embodied process, the contact temperature is usually −50 to 100° C., preferably 0 to 60° C., and the contact pressure is 0 to 2 MPa.

Also in the second embodied process of the present invention, the mercury is converted into the solid mercury compound through the ionization of the mercury and the subsequent contact with the sulfur compound. The solid mercury compound is removed preferably by solid-liquid separation in the same tank as used in the sulfur compound-treatment. More specifically, the liquid hydrocarbon is allowed to stand preferably for 6 hr or longer, more preferably 12 hr or longer, still more preferably 24 hr or longer after the contact treatment with the sulfur compound, and then the solid mercury compound is removed from the liquid hydrocarbon by a known solid-liquid separation such as filtration and sedimentation.

The present invention will now be described in more detail by reference to the following examples. However, it should be noted that the following examples are illustrative and not intended to limit the invention thereto.

EXAMPLE 1

A liquid hydrocarbon composed of a condensate A (density: 0.7363 g/cm$^3$ at 15° C.) having a mercury content of 37 W/V ppb (elementary mercury:ionic mercury=77%:23%) was continuously fed to an ionization column filled with 0.3 L of the following mercury-ionizing substance, and the ionization of mercury was conducted under the following conditions:

Reaction temperature: 25° C.

Reaction pressure: 0.1 MPa (absolute pressure)

Liquid hourly space velocity: 10 hr$^{-1}$

Mercury-ionizing substance: manganese dioxide

As a result, a condensate B having a mercury content of 37 W/V ppb (elementary mercury:ionic mercury=0%:100%) was obtained.

Then, the condensate B and hydrogen sulfide were continuously fed into a 3-L reactor equipped with a stirrer. The solidification of the mercury was carried out under the following conditions to obtain a condensate C containing a solid mercury compound.

Reaction temperature: 25° C.

Reaction pressure: 0.1 MPa (absolute pressure)

Residence time: 1 hr

Hydrogen sulfide/mercury: 1,000 (by mol)

The condensate C was subjected to a continuous solid-liquid separation by passing through a filter with 5 μm pore size to obtain a condensate D. The mercury concentration of the condensate D was 1.2 W/V ppb.

EXAMPLE 2

A condensate A was fed to the mercury-ionization zone and then treated with hydrogen sulfide in the same manner as in Example 1, thereby obtaining a condensate C2 containing the solid mercury compound. The condensate C2 was placed in a container and allowed to stand to sediment the solid mercury compound. The mercury concentration of the supernatant which was sampled after sedimentation was 1.0 W/V ppb.

EXAMPLE 3

The ionization was performed in the same manner as in Example 1 except that the ionization temperature was changed to 2° C., thereby obtaining a condensate B3 having a mercury content of 37 W/V ppb (elementary mercury:ionic mercury=1%:99%). Then, the condensate B3 was treated with hydrogen sulfide in the same manner as in Example 1, and subjected to solid-liquid separation using a filter with 5 μm pore size to obtain a condensate D3. The mercury concentration of the condensate D3 was 1.4 W/V ppb.

EXAMPLE 4

The ionization was performed in the same manner as in Example 1 except that the ionization temperature was changed to 40° C., thereby obtaining a condensate B4 having a mercury content of 37 W/V ppb (elementary mercury:ionic mercury=0%:100%). Then, the condensate B4 was treated with hydrogen sulfide in the same manner as in Example 1, and subjected to solid-liquid separation using a filter with 5 μm pore size to obtain a condensate D4. The mercury concentration of the condensate D4 was 0.9 W/V ppb.

EXAMPLE 5

The procedures of Example 1 were repeated except for changing the hydrogen sulfide/mercury molar ratio to 100 to obtain a condensate, which was then subjected to solid-liquid separation using a filter with 5 μm pore size to obtain a condensate D5. The mercury concentration of the condensate D5 was 1.8 W/V ppb.

EXAMPLE 6

The procedures of Example 1 were repeated except for changing the hydrogen sulfide/mercury molar ratio to 10,000 to obtain a condensate, which was then subjected to solid-liquid separation using a filter with 5 μm pore size to obtain a condensate D6. The mercury concentration of the condensate D6 was 0.9 W/V ppb.

EXAMPLE 7

A liquid hydrocarbon composed of a condensate A (density: 0.7363 g/cm$^3$ at 15° C.) having a mercury content of 37 W/V ppb (elementary mercury:ionic mercury=77%:23%) and the following mercury-ionizing substance were fed to a 300-mL ionization container equipped with a stirrer to ionize the mercury under the following conditions:

Reaction temperature: 25° C.

Reaction pressure: 0.1 MPa (absolute pressure)

Mercury-ionizing substance: 0.9 wt % iron(III) sulfate aqueous solution

Feed rate of condensate A: 1.5 L/hr

Feed rate of iron(III) sulfate aqueous solution: 1.5 L/hr

As a result, a condensate B7 having a mercury content of 37 W/V ppb (elementary mercury:ionic mercury=0%:100%) was obtained.

Then, the condensate B7 and hydrogen sulfide were fed into a 3-L reactor equipped with a stirrer to convert the mercury to the solid compound under the following conditions, thereby obtaining a condensate C7 containing the solid mercury compound.

Reaction temperature: 25° C.

Reaction pressure: 0.1 MPa (absolute pressure)

Residence time: 1 hr

Hydrogen sulfide/mercury: 1,000 (by mol)

The condensate C7 was continuously subjected to solid-liquid separation by passing through a filter with 5 μm pore size to obtain a condensate D7. The mercury concentration of the condensate D7 was 1.3 W/V ppb.

EXAMPLE 8

A liquid hydrocarbon composed of a condensate A (density: 0.7363 g/cm$^3$ at 15° C.) having a mercury content of 37 W/V ppb (elementary mercury:ionic mercury=77%:23%) was fed to an ionization column filled with 0.3 L of the following mercury-ionizing substance, and the ionization of mercury was conducted under the following conditions:

Reaction temperature: 25° C.

Reaction pressure: 0.1 MPa (absolute pressure)

Liquid hourly space velocity: 10 $hr^{-1}$

Mercury-ionizing substance: manganese dioxide

As a result, a condensate B8 having a mercury content of 37 W/V ppb (elementary mercury:ionic mercury=0%:100%) was obtained.

Then, the condensate B8 and hydrogen sulfide were fed into a 50-L tank equipped with a stirrer. The solidification of the mercury was carried out under the following conditions:

Reaction temperature: 25° C.

Reaction pressure: 0.1 MPa (absolute pressure)

Residence time: 12 hr

Hydrogen sulfide/mercury: 1,000 (by mol)

After the treatment with hydrogen sulfide, the condensate was allowed to stand for 20 hr. The mercury concentration of the supernatant which was sampled after standing was 1.8 W/V ppb.

EXAMPLE 9

A condensate A was fed to the mercury-ionization column and then treated with hydrogen sulfide in the same manner as in Example 8, thereby obtaining a condensate B9 containing the solid mercury compound. After the treatment with hydrogen sulfide, the resulting condensate was allowed to stand. The mercury concentration of each supernatant which was sampled after 24-hr standing or 48-hr standing was 1.1 W/V ppb.

Industrial Applicability

In accordance with the present invention, mercury is removed from a mercury-containing liquid hydrocarbon with ease in a continuous or semi-continuous manner at around ordinary temperature under around ordinary pressure, thereby reducing the mercury concentration of the liquid hydrocarbon to 2 W/V ppb or lower.

What is claimed is:

1. A process for removing mercury from a mercury-containing liquid hydrocarbon, comprising:

(A) continuously feeding a mercury-containing liquid hydrocarbon into a first ionization zone where said liquid hydrocarbon is contacted with a substance capable of ionizing elementary mercury, thereby ionizing the elementary mercury in the mercury-containing liquid hydrocarbon;

(B) continuously feeding the resultant liquid hydrocarbon containing the ionized mercury into a second sulfur compound-treatment zone, where said resultant liquid hydrocarbon is contacted with a sulfur compound, which optionally may be contained in a liquid, represented by the general formula:

MM'S wherein M and M' may be the same or different and are each independently a hydrogen atom, an alkali metal or an ammonium group, thereby converting the ionized mercury into a solid mercury compound; and (C) removing the solid mercury compound from the liquid hydrocarbon.

2. The process of claim 1, wherein the first ionization zone in (A) is an ionization column and the second sulfur-treatment zone in (B) is a tank.

3. The process of claim 1, wherein said resultant liquid hydrocarbon containing the ionized mercury in (B) is contacted with a liquid containing said sulfur compound.

4. The method of claim 1, where said sulfur compound in (B) is not contained in a liquid.

5. The method of claim 1, wherein said mercury-containing liquid hydrocarbon is crude oil.

6. The method of claim 1, wherein said mercury-containing liquid hydrocarbon is straight run naphtha.

7. The method of claim 1, wherein said mercury-containing liquid hydrocarbon is kerosene.

8. The method of claim 1, wherein said mercury-containing liquid hydrocarbon is gas oil.

9. The method of claim 1, wherein said mercury-containing liquid hydrocarbon is vacuum distillate.

10. The method of claim 1, wherein said mercury-containing liquid hydrocarbon is topped crude.

11. The method of claim 1, wherein said mercury-containing liquid hydrocarbon is natural gas condensate.

12. The process according to claim 1, wherein the substance capable of ionizing elementary mercury is an aqueous solution containing iron (III) ions.

13. The process according to claim 1, wherein the substance capable of ionizing elementary mercury is manganese dioxide and/or a supported manganese dioxide.

14. The process according to claim 1, wherein the sulfur compound is hydrogen sulfide.

15. The process according to claim 1, wherein the sulfur compound is one or more compounds selected from the group consisting of sodium hydrosulfide, potassium hydrosulfide, ammonium hydrosulfide, sodium sulfide, potassium sulfide, and ammonium sulfide.

16. The process according to claim 1, wherein the ionization of elemental mercury is performed at −50 to 100° C. under 0 to 2 MPa.

17. The process according to claim 1, wherein the sulfur compound-treatment is performed at −50 to 100° C. under 0 to 2 MPa.

18. The process according to claim 1, wherein the amount of the sulfur compound introduced into the sulfur compound-treatment zone is 1 to 10,000 mol per one mol of mercury contained in the liquid hydrocarbon.

19. The process according to claim 1, wherein the solid mercury compound is removed in (C) by a solid-liquid separation.

20. The process according to claim 1, wherein the sulfur treatment is performed in a tank and the solid mercury compound is removed by solid-liquid separation in said tank.

* * * * *

UNITED STATES PATENT AND TRADEMARK OFFICE

CERTIFICATE OF CORRECTION

PATENT NO. : 6,806,398 B2
DATED : October 19, 2004
INVENTOR(S) : Sakai et al.

It is certified that error appears in the above-identified patent and that said Letters Patent is hereby corrected as shown below:

Title page,
Items [45] and [*] Notice, should read as follows:

-- [45] **Date of Patent: *Oct. 19, 2004**

[*] Notice: Subject to any disclaimer, the term of this patent is extended or adjusted under 35 U.S.C. 154(b) by 0 days.

This patent is subject to a terminal disclaimer. --

Signed and Sealed this

Eighth Day of February, 2005

JON W. DUDAS
*Director of the United States Patent and Trademark Office*